US007628671B2

(12) United States Patent
Choi

(10) Patent No.: US 7,628,671 B2
(45) Date of Patent: Dec. 8, 2009

(54) PROGRAMMABLE FLYING OBJECT

(75) Inventor: Kei Fung Choi, Causeway Bay (HK)

(73) Assignee: Silverlit Toys Manufactory Ltd., Hong Kong (HK)

( * ) Notice: Subject to any disclaimer, the term of this patent is extended or adjusted under 35 U.S.C. 154(b) by 404 days.

(21) Appl. No.: 10/998,018

(22) Filed: Nov. 26, 2004

(65) Prior Publication Data

US 2006/0113428 A1 Jun. 1, 2006

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 446/57; 446/37; 446/60; 446/65; 446/225; 124/26; 244/3.27; 701/3

(58) Field of Classification Search ..... 446/45, 446/34, 36, 37, 63, 38–44, 230–232, 64, 446/65, 57–60, 454, 455, 456; 244/190, 244/3.12; 89/1.8

See application file for complete search history.

(56) References Cited

U.S. PATENT DOCUMENTS

| | | | | | |
|---|---|---|---|---|---|
| 1,565,437 | A | * | 12/1925 | Greife | 446/65 |
| 2,017,778 | A | * | 10/1935 | Vido | 124/26 |
| 3,570,467 | A | * | 3/1971 | Belokin, Jr. | 124/26 |
| 3,868,883 | A | * | 3/1975 | Tucker | 89/1.8 |
| 3,957,230 | A | * | 5/1976 | Boucher et al. | 244/53 R |
| 3,995,392 | A | * | 12/1976 | Goldfarb et al. | 446/58 |
| 4,155,194 | A | * | 5/1979 | Amamoto et al. | 446/65 |
| 4,180,939 | A | * | 1/1980 | Matsushiro | 446/38 |
| 4,296,894 | A | * | 10/1981 | Schnabele et al. | 244/3.27 |
| 4,553,718 | A | * | 11/1985 | Pinson | 244/3.15 |
| 4,604,075 | A | * | 8/1986 | Richards et al. | 446/232 |
| 4,660,170 | A | * | 4/1987 | Hui et al. | 710/316 |
| 4,907,763 | A | * | 3/1990 | Pinson | 244/3.12 |
| 4,931,028 | A | * | 6/1990 | Jaeger et al. | 446/225 |
| 4,964,331 | A | * | 10/1990 | Halevy et al. | 89/37.19 |
| 4,981,456 | A | * | 1/1991 | Sato et al. | 446/36 |
| 5,024,626 | A | * | 6/1991 | Robbins et al. | 446/409 |
| 5,129,852 | A | * | 7/1992 | Crisci et al. | 446/60 |
| 5,158,495 | A | * | 10/1992 | Yonezawa | 446/456 |
| 5,344,354 | A | * | 9/1994 | Wiley | 446/7 |
| 5,347,910 | A | * | 9/1994 | Avila et al. | 89/41.22 |
| 5,395,275 | A | * | 3/1995 | Johnson et al. | 446/60 |
| 5,634,839 | A | * | 6/1997 | Dixon | 446/37 |
| 5,672,086 | A | * | 9/1997 | Dixon | 446/37 |
| 5,711,285 | A | * | 1/1998 | Stewart et al. | 124/67 |

(Continued)

FOREIGN PATENT DOCUMENTS

| | | | |
|---|---|---|---|
| FR | 2608449 | * | 6/1988 |

*Primary Examiner*—John M. Hotaling, II
*Assistant Examiner*—Paul A. D'Agostino
(74) *Attorney, Agent, or Firm*—Greenberg Traurig LLP

(57) ABSTRACT

A launcher has programmable keys that activate a programming device to communicate with a flying toy to set up any one of multiple different motions of the toy. This is affected when the flying object and the launcher are connected together. Different combinations of program keys include changing of speed and landing procedures. The flying toy includes a receiver that operates a motor, and the flying object is clipped on the launcher and ejected after a user triggers the release button on the launcher.

12 Claims, 13 Drawing Sheets

U.S. PATENT DOCUMENTS 5,803,789 A * 9/1998 Dean et al. ..... 446/455
5,907,117 A * 5/1999 Persson et al. ..... 89/1.11
6,119,976 A * 9/2000 Rogers ..... 244/13
6,609,945 B2 * 8/2003 Jimenez et al. ..... 446/454
6,612,893 B2 * 9/2003 Rehkemper et al. ..... 446/34
6,843,699 B2 * 1/2005 Davis ..... 446/37
6,855,028 B2 * 2/2005 Siegel ..... 446/486
7,018,264 B2 * 3/2006 Foster et al. ..... 446/435
7,077,359 B2 * 7/2006 Poesch et al. ..... 244/63
7,097,136 B2 * 8/2006 Ruszkowski, Jr. ..... 244/105
7,100,866 B2 * 9/2006 Rehkemper et al. ..... 244/17.13
7,219,861 B1 * 5/2007 Barr ..... 244/190
7,255,623 B2 * 8/2007 Davis ..... 446/36
2002/0022909 A1 * 2/2002 Karem ..... 701/3
2002/0132556 A1 * 9/2002 So ..... 446/456
2002/0142699 A1 * 10/2002 Davis ..... 446/37
2003/0001045 A1 * 1/2003 Yifrach ..... 244/35 R
2003/0040247 A1 * 2/2003 Rehkemper et al. ..... 446/34
2004/0116044 A1 * 6/2004 Foster et al. ..... 446/435
2004/0200924 A1 * 10/2004 Clark et al. ..... 244/7 B
2004/0248497 A1 * 12/2004 Poesch et al. ..... 446/61
2005/0151023 A1 * 7/2005 Ribbe ..... 244/190
2006/0089075 A1 * 4/2006 Windt ..... 446/34

* cited by examiner

PROGRAMMABLE FLYING OBJECT

BACKGROUND

This disclosure relates to a flying system. In particular, it relates to a flyable object that can be preprogrammed with a separate device.

Many programmable toys are known. None however has the characteristics of the present disclosure, which relates to programming a flyable object with a separable programmable unit. This construction and configuration has unique characteristics to provide a toy for interesting use.

SUMMARY

A flying system comprises a flyable object and a launcher. The launcher includes a programming device with programmable keys which can activate a flying object such as a flyable toy to set up any one of multiple different motions of the toy.

The device can be a toy, such as a plane, or a flying object such as helicopter, UFO, or other movable object for movement in the air, for instance a powered rocket, blimp or air balloon. To program the toy, different combination of program buttons are keyed in to include changing of speed levels and intercept landing procedure.

Players can design different flying patterns through keys in different combinations of action keys. The flying toy is clipped on the launcher and ejected out after a player triggers the release button. Before ejecting, a player can key in the programming key to obtain an ideal flying pattern.

Other objects and features of the disclosure will become apparent from the following detailed description and accompanying drawings.

DRAWINGS

The above-mentioned features and objects of the present disclosure will become more apparent with reference to the following description taken in conjunction with the accompanying drawings wherein like reference numerals denote like elements and in which.

DESCRIPTION

The device is now described with reference to an example, which is not to be considered as limiting. This is purely an illustration of the device.

A programmable flying system comprising a body and elements with the body to permit flight. The elements include a rotating element to permit propulsion of the object.

There is a launch device for receiving the flyable object prior to flight, and on release from the launch pad of the launch device, the flyable object takes flight.

The launch device includes a programming device or unit to permit the programming unit to connect with a communication circuit and transmit programming information or data to the flyable object. The flyable object includes a receiver for receiving the programmed information, and the receiver interacting with a motor in the flyable object. The motor operates at least one element of the flyable object thereby to permit the flyable object to operate according to the program regulating the motor action.

The motor in the flyable object controls at least one of a rudder, propeller or elevator associated with a plane. The programmable device on the launch device is operable through at least one of a keypad, voice command, joystick, light or infrared input. The programmable device is separable from the input device to the programmable device and the output device in the flyable object. The programming device includes an integral input device and output device for communicating to the flyable object.

The system includes a rechargeable battery inside the flyable object. The launch device includes a compartment for receiving batteries, the batteries being for permitting charging to disseminate from the launching device to the rechargeable batteries in the flyable object.

The flying system includes hardwires between the launch device and the flyable object. These wires transmit both data communication between the programming device to the receiver on the plane, and also power to the rechargeable batteries on the flyable object.

The launching device is a unit with a base permitting standing on a foundation and being balanced to prevent tipping when the flyable object is located on the launching ramp to prevent tipping when the flyable object is removed from the launching ramp. The launching device includes the base, an upstanding pedestal and the launch ramp. The base and the launch ramp are directed substantially in line and forwardly in the same direction as the base. The launch device includes a trigger to facilitate release of the flyable object from the launch pad on manual operation of the trigger.

A toy plane which is the flyable object in the exemplary embodiment can be programmed and activated by a device which is a pistol-shape launcher, so that the plane can perform different flying patterns in the sky.

Figure 1:
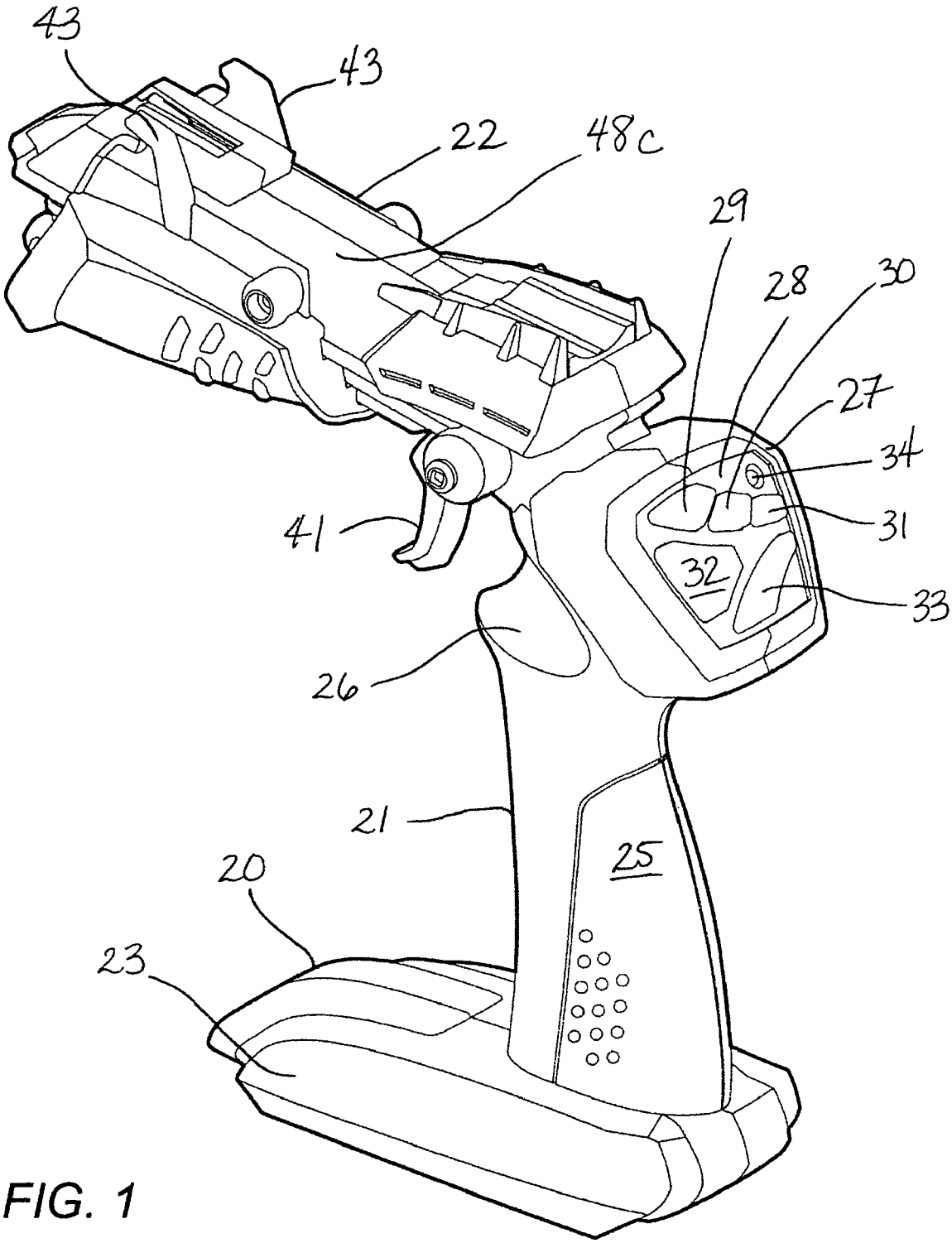
FIG. 1 is a perspective view of the launch device for the flying object as viewed from the rear.
Figure 2:
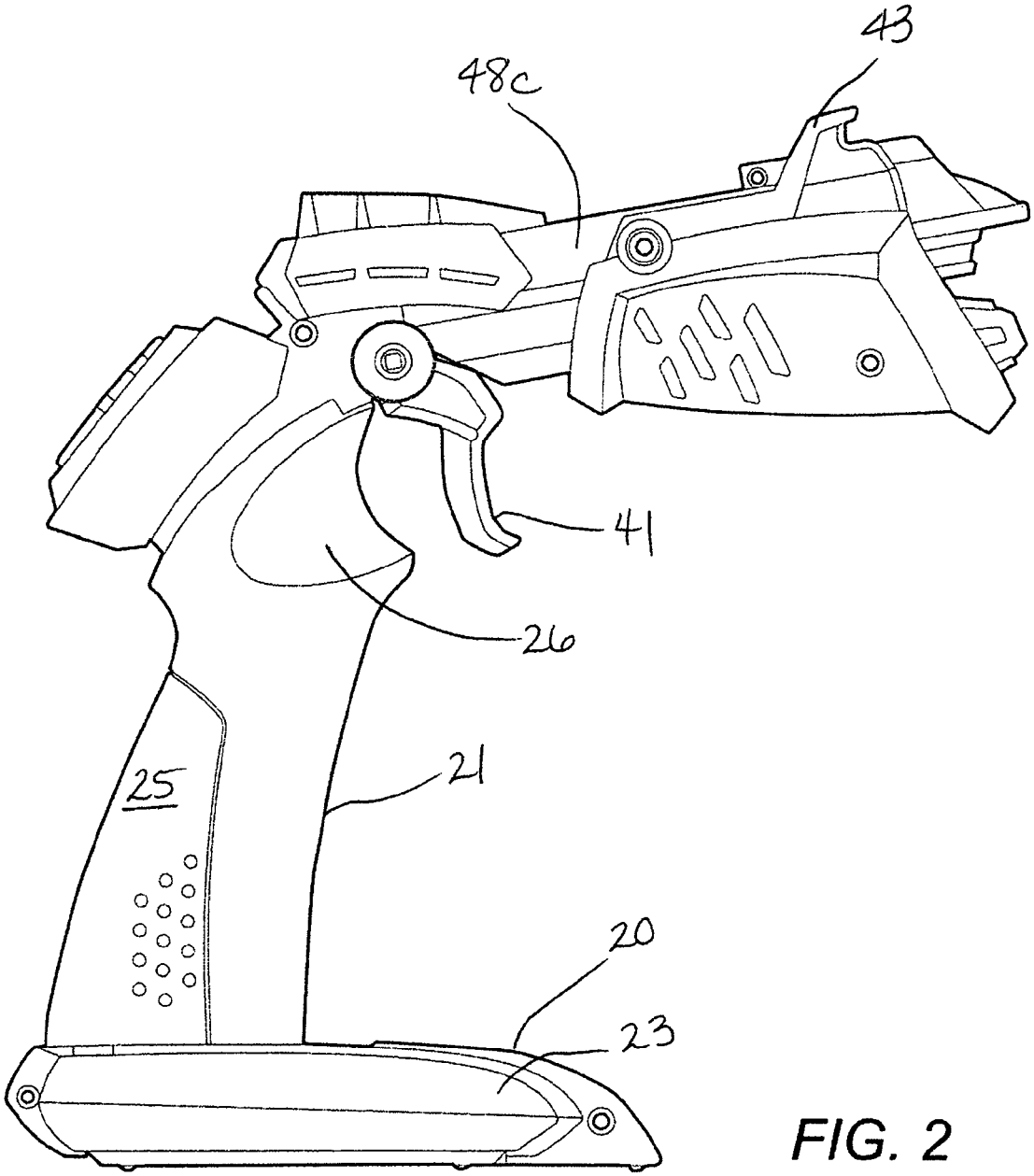
FIG. 2 is a side view of the launch device for the flying object.
Figure 3:
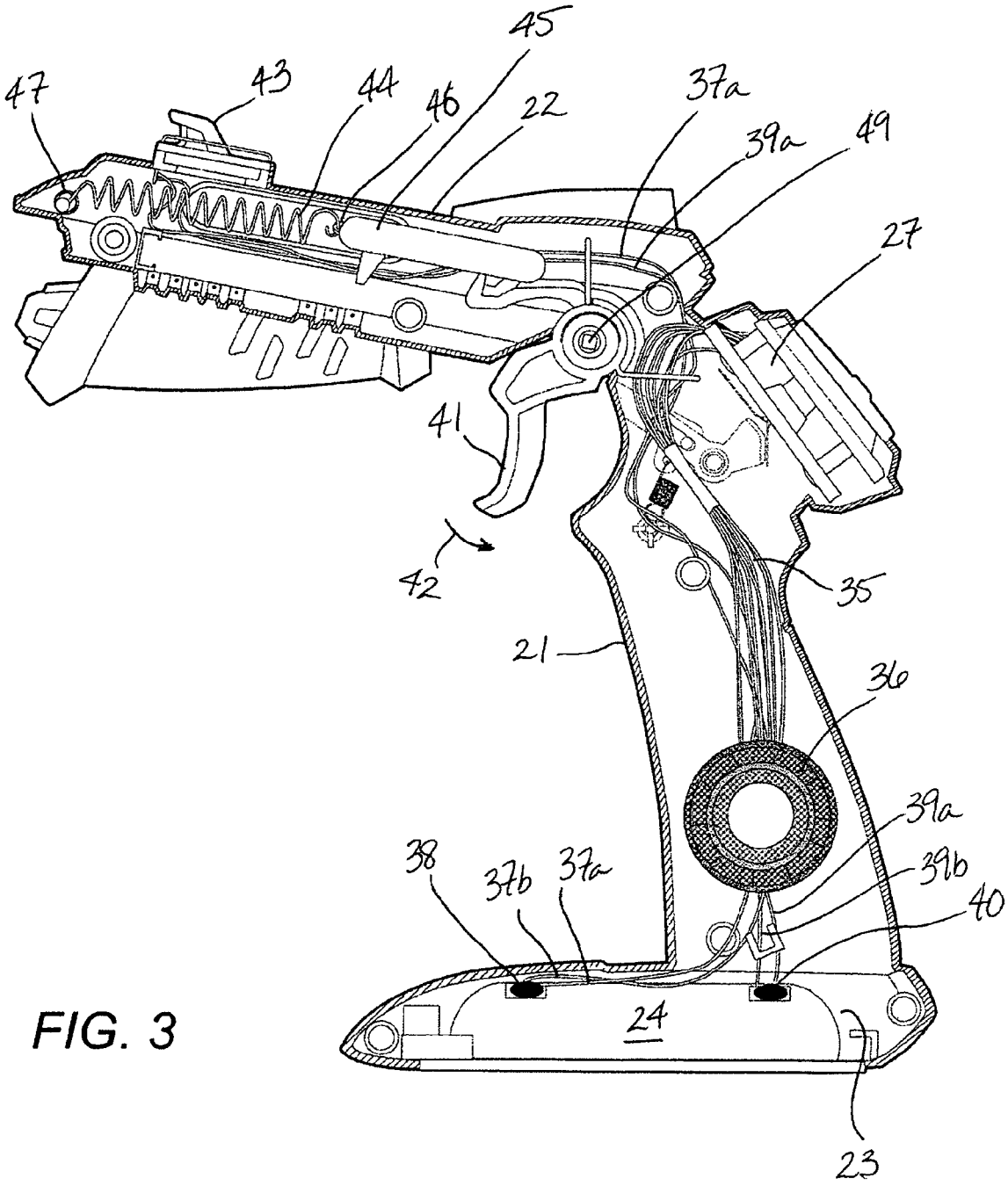
FIG. 3 is a partial sectional side view of the launch device for the flying object.
Figure 4:
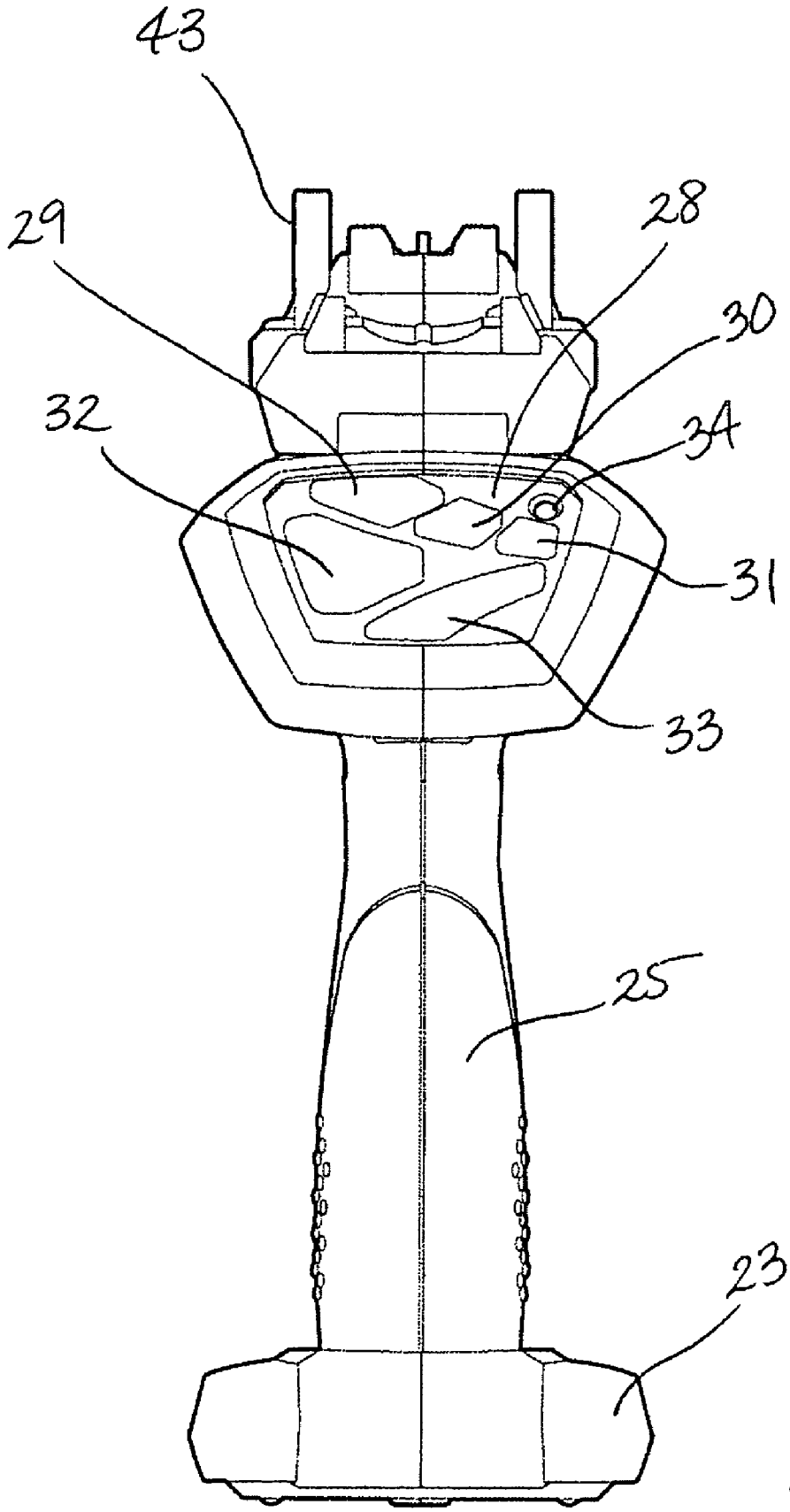
FIG. 4 is a rear view of the launch device for the flying object.
Figure 5:
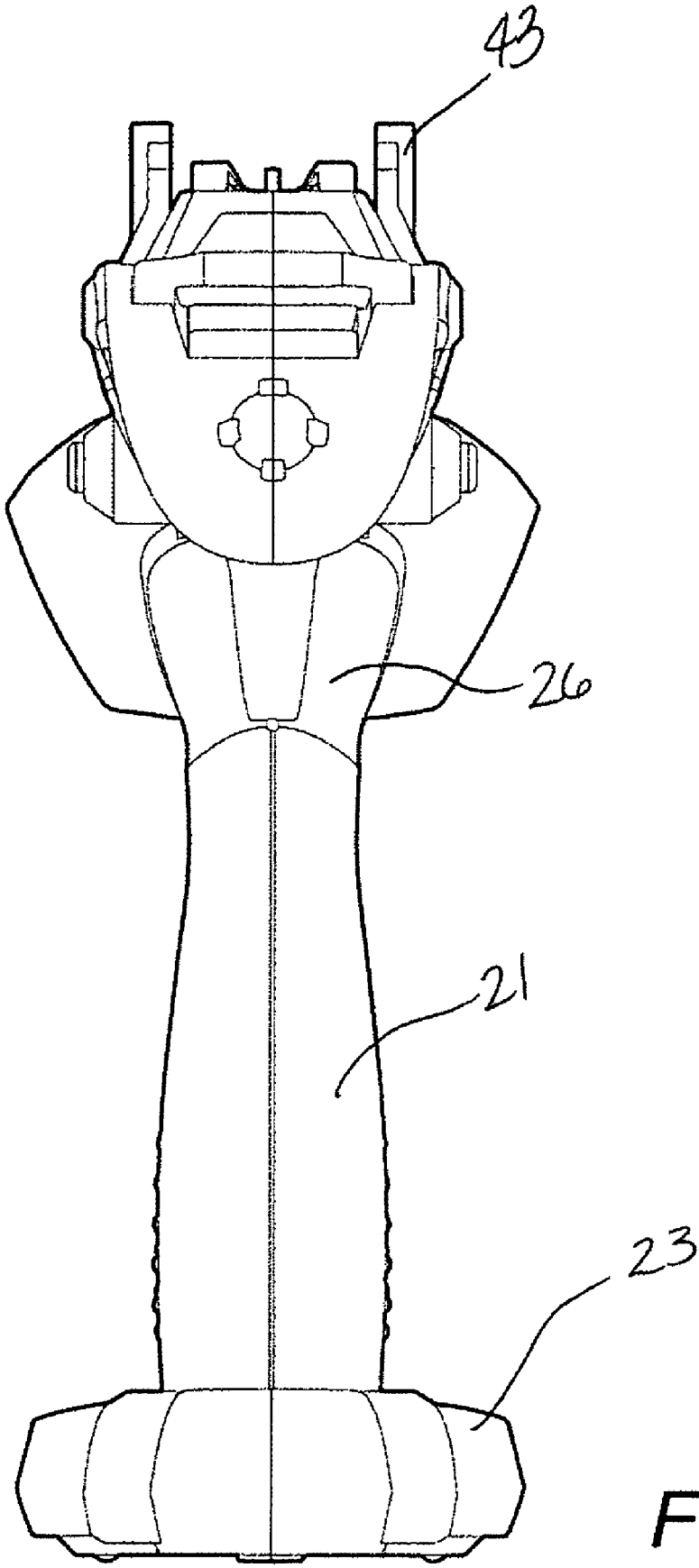
FIG. 5 is a front view of the launch device for the flying object.
Figure 6:
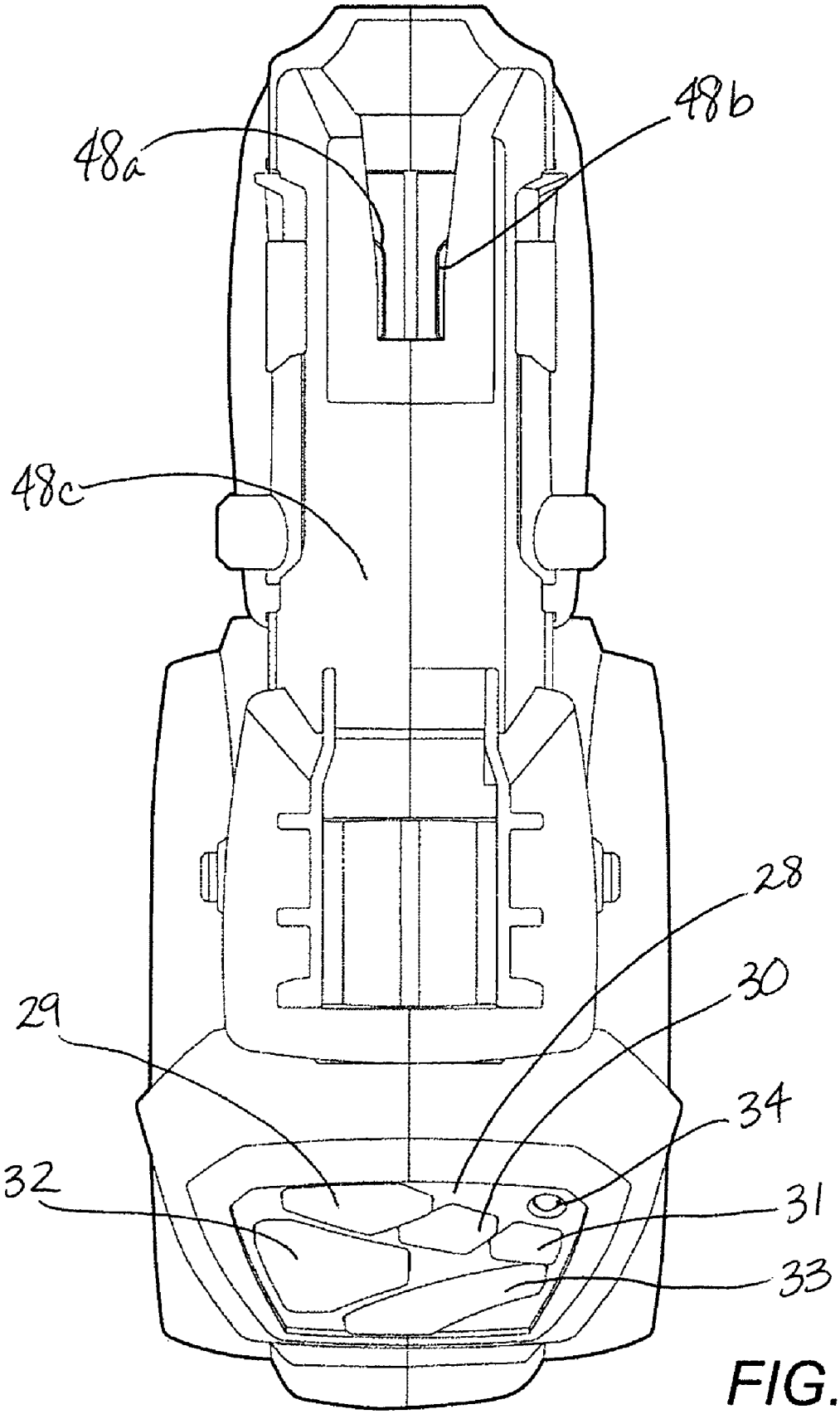
FIG. 6 is a top view of the launch device for the flying object.
Figure 7:
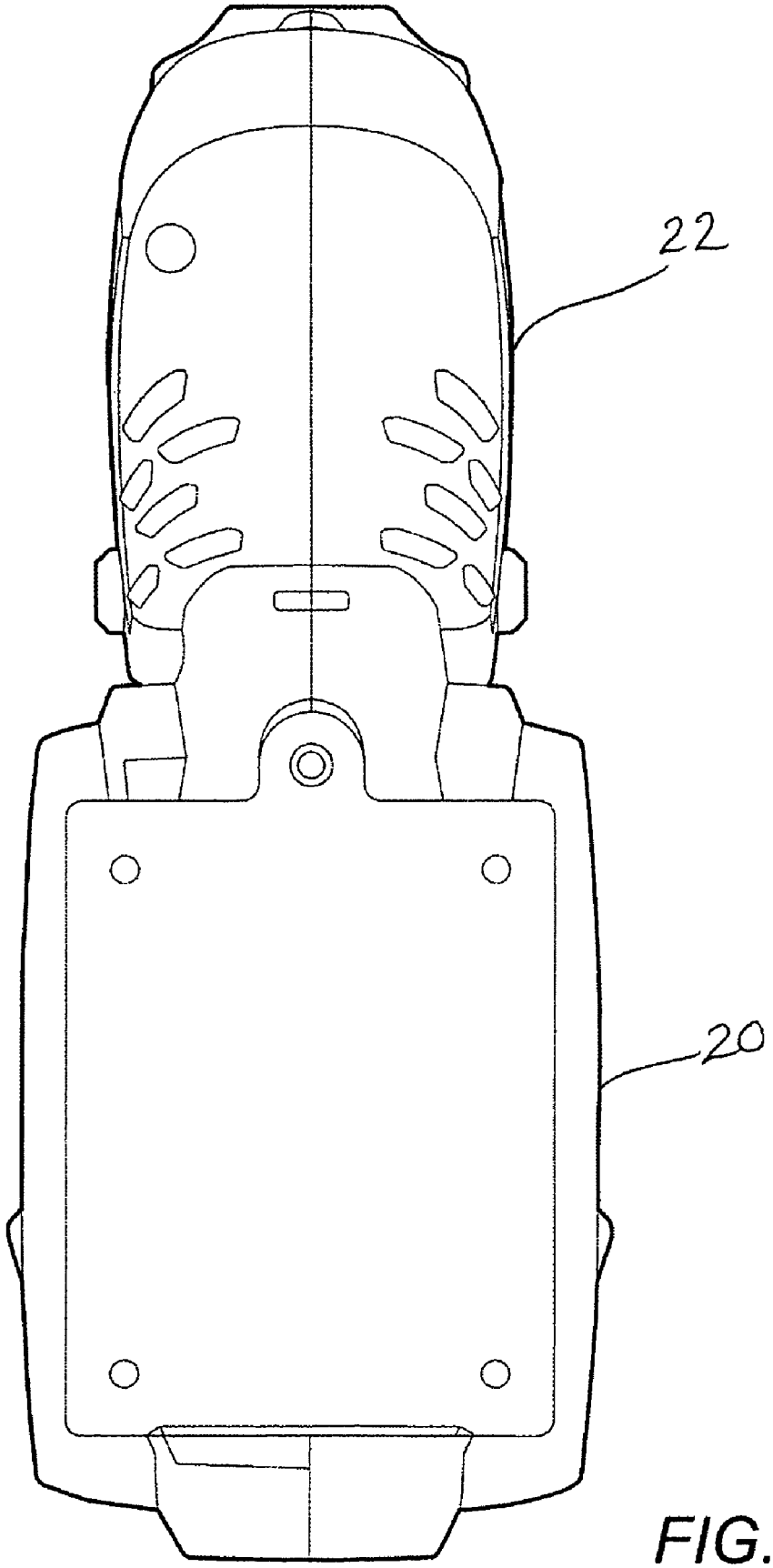
FIG. 7 is an under view of the launch device for the flying object.
Figure 8:
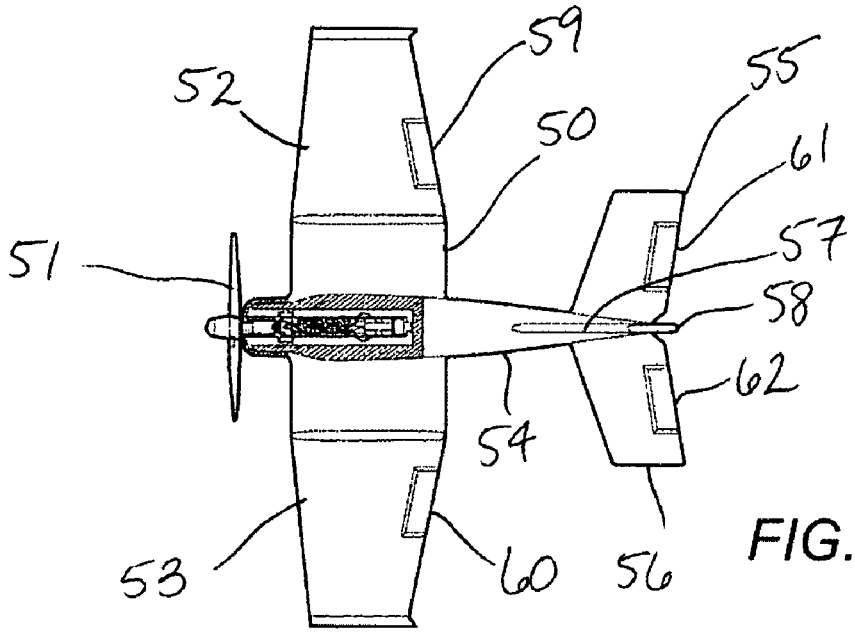
FIG. 8 is a partial top view partly in section of the plane being the flying object.
Figure 9:
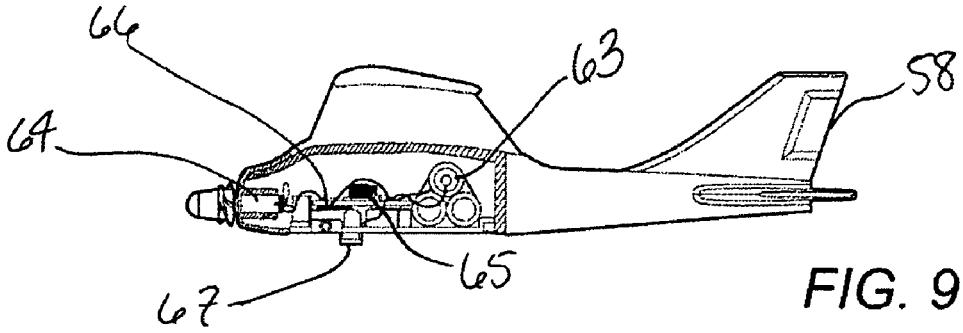
FIG. 9 is a side view partly in section of the plane.
Figure 10:
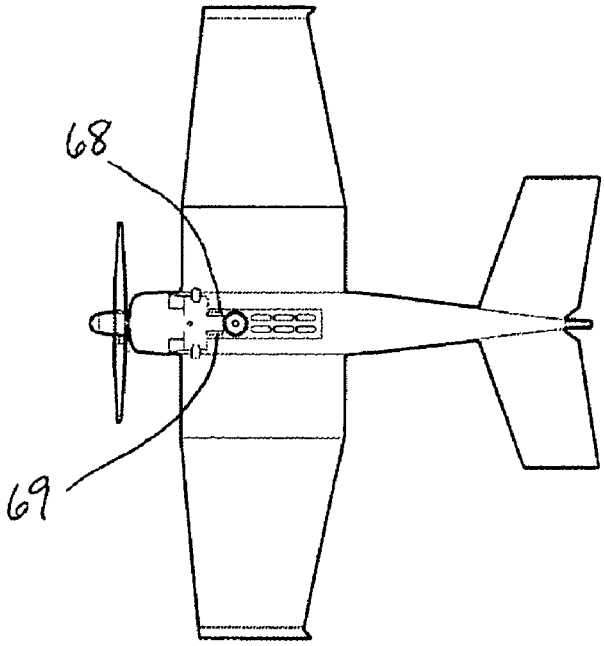
FIG. 10 is an under view of the plane.
Figure 11:
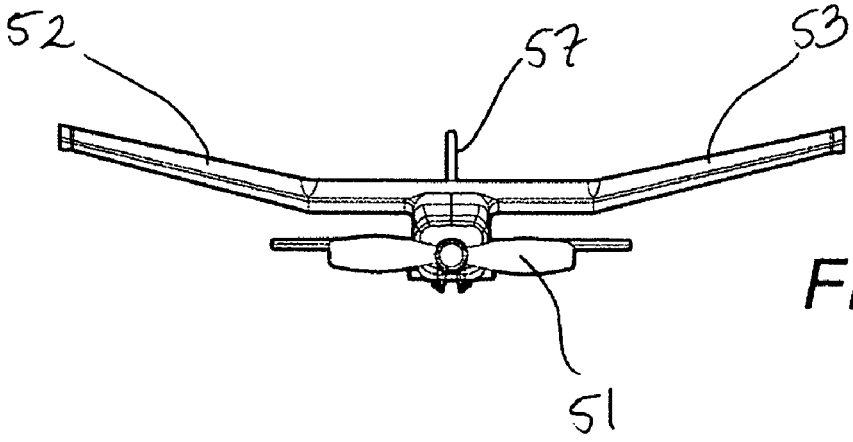
FIG. 11 is a front view of the plane.
Figure 12:
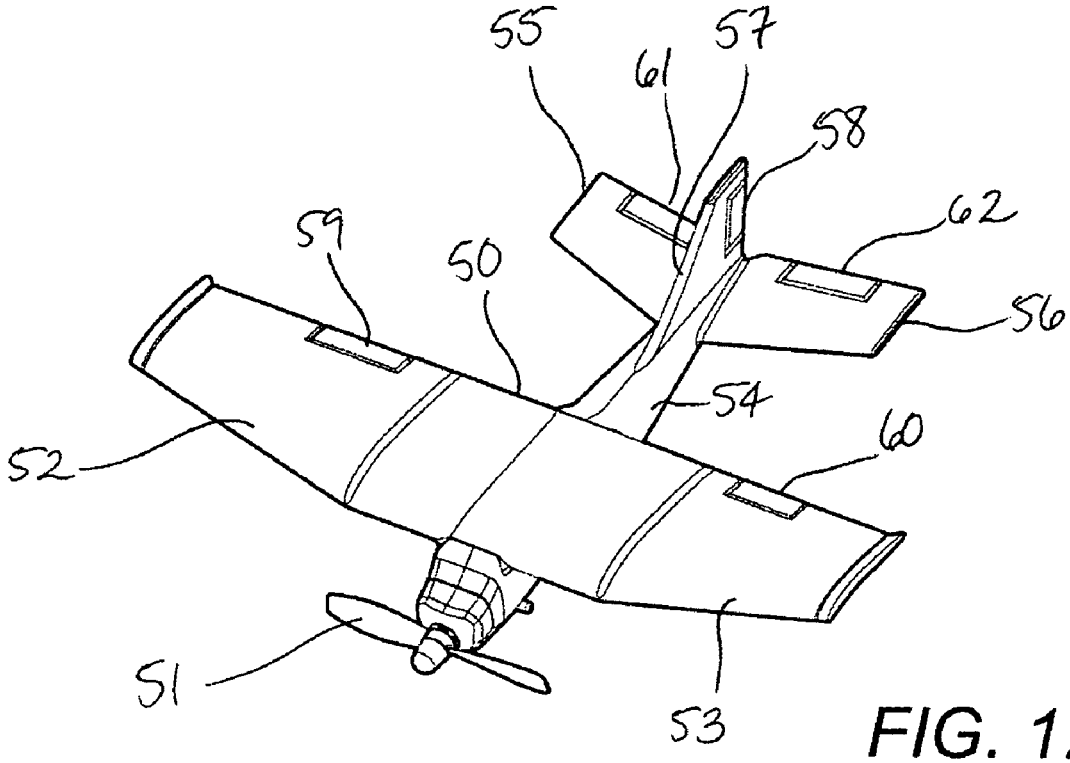
FIG. 12 is an isometric view of the plane.

FIG. 1 shows a pistol-shaped launcher which includes a base 20, a pedestal 21, and a launch pad or ramp 22. The base 20 is forwardly directed in the same direction as the launch pad 22. The base 20 includes a battery compartment 23 for locating batteries 24. The outside surface 25 of the pedestal is for hand-gripping as the case may be by a user of the toy. A molded indented reception area 26 is provided at the top of the pedestal adjacent to the underneath of the ramp for receiving an index finger of the user, as may be necessary.

At the rear of the pedestal, there is a programming device 27 with a keypad 28. The keypad includes different keys 29, 30, 31, 32 and 33 for use as necessary to effect programming of a programmable unit which is part of the launcher. An LED 34 is also mounted in the keypad to indicate different functions of the programmable device. The programmable device is hardwired through a series of wires 35 which are directed from a power distribution center 36 mounted in the pedestal 21. The distribution center 36 can include a transformer or other converter as may be necessary two wires 37*a* and 37*b* are directed from one side of the battery terminal 38 and two wires 39*a* and 39*b* are directed from the terminal 40 of the battery 24.

As such, the wires 37*a* and 39*a* are directed to power the flyable object and as such the wires are directed up the pedestal 21 and into the launch pad area 22 as indicated. The wires 37*b* and 39*b* are directed to the distributor 36 and in turn, they are bundled into different wires 35 which operate the electronic programming device 27 in different fashions. Different voltages and powers are provided to the programmer so that the programmer can perform different functions as necessary.

Between the pedestal 21 and the launch pad 22 in the front at the intersection near the reception area 26 there is a trigger 41 which is operable by the finger of the user as necessary. The operation of the trigger 41 by pulling rearwardly is indicated by arrow 42 towards the pedestal 21. This causes hook members 43 at the forward area of the launch pad 22 to be released and permit the launching of the flyable object as required. The hooks 43 can be spring loaded through coil spring 44 and a slider 45 so that the spring extends between a hole 46 and a second hole 47 in front of the body of the flying vehicle which is to be launched.

The two hooks 43 are to either side of the ramp 48*c* on the top of the launch pad or slider 22. The wires 37*a* and 39*a* protrude to make respective contact with two metal contacts or rails 48*a* and 48*b* respectively. These contacts engage mating contacts on the flyable object as will be described when the flyable object is located in the hooked position on the slider ramp 48*c*.

The trigger 41 is pivoted about a mounting 49 to permit the rotatable movement of the trigger as indicated by the arrow 42. Manual resetting of the trigger can be effected as necessary after its release by manually returning the trigger to the pre-released stage. Alternatively, this resetting can be done automatically on return of the trigger.

The flying object illustrated in the disclosure is a plane 59 which has a propeller 51, two wings 52 and 53, a body 54, tail wings 55 and 56, a tail or fin 57. There is a rudder 58 mounted at the rear of the tail. Elevators 59, 60, 61 and 62 can be also provided to the plane. Inside the plane, there is a rechargeable battery pack 63 which is connected to a motor 64. The motor operates the propeller 51 and the rudder and elevators as necessary through suitable mechanical connections and/or gearing.

There is also a receiver circuit 65 mounted on a board 66. A start/stop button or switch 67 is mounted under the body of the plane. There are two contacts 68 and 69 on the under belly of the plane which engage with the contacts 48*a* and 48*b* when the plane is on the launch ramp 48*c*. The inside of the body of the plane is wired from the programmable receiver to permit activation of the rudder 58 and one or more of the elevators 59, 60, 61 and 62 to permit appropriate movement according to the programmed condition of the plane.

Figure 13:
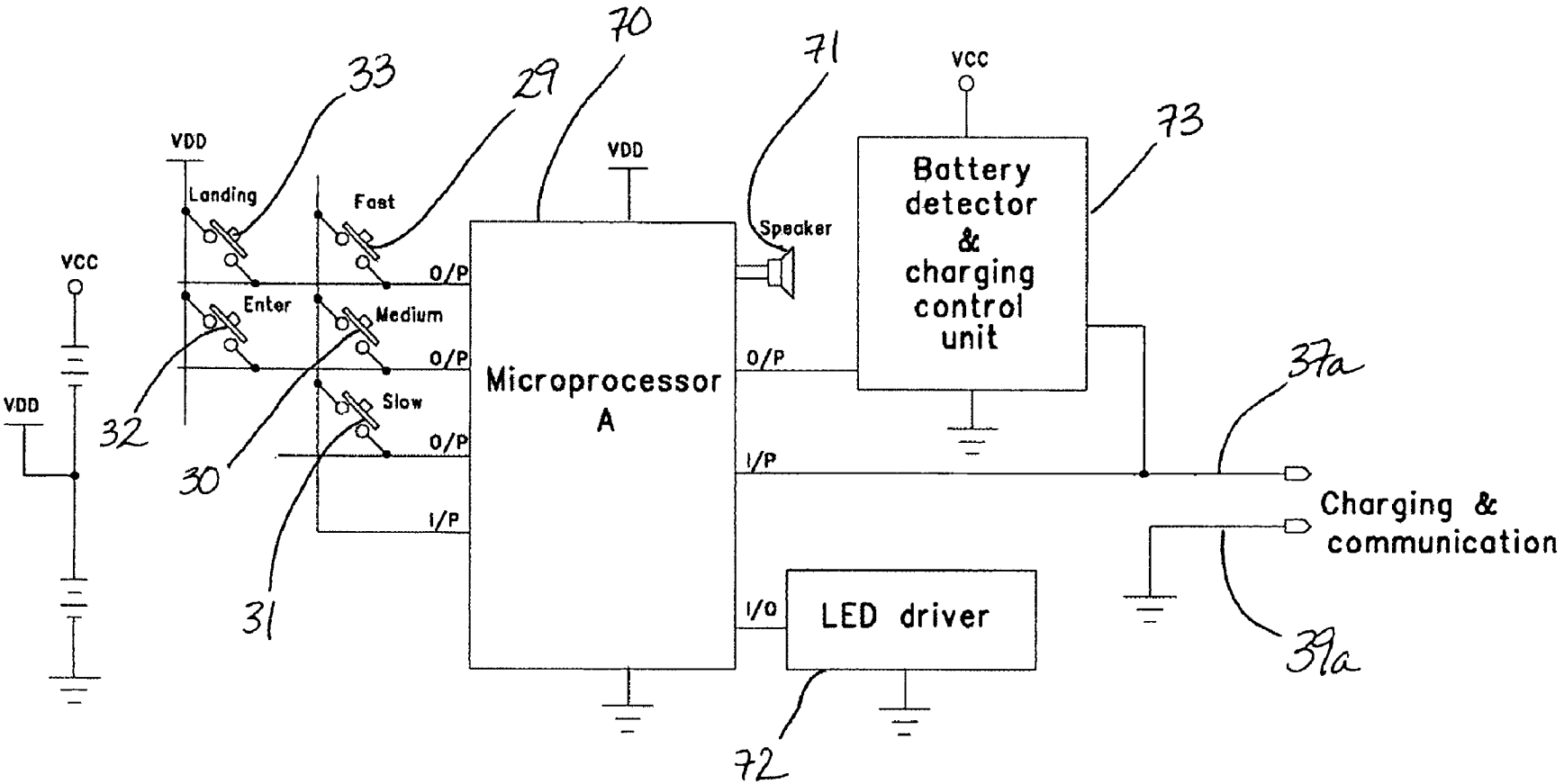
FIG. 13 is a block diagram of the launcher for the flying object.
Figure 14:
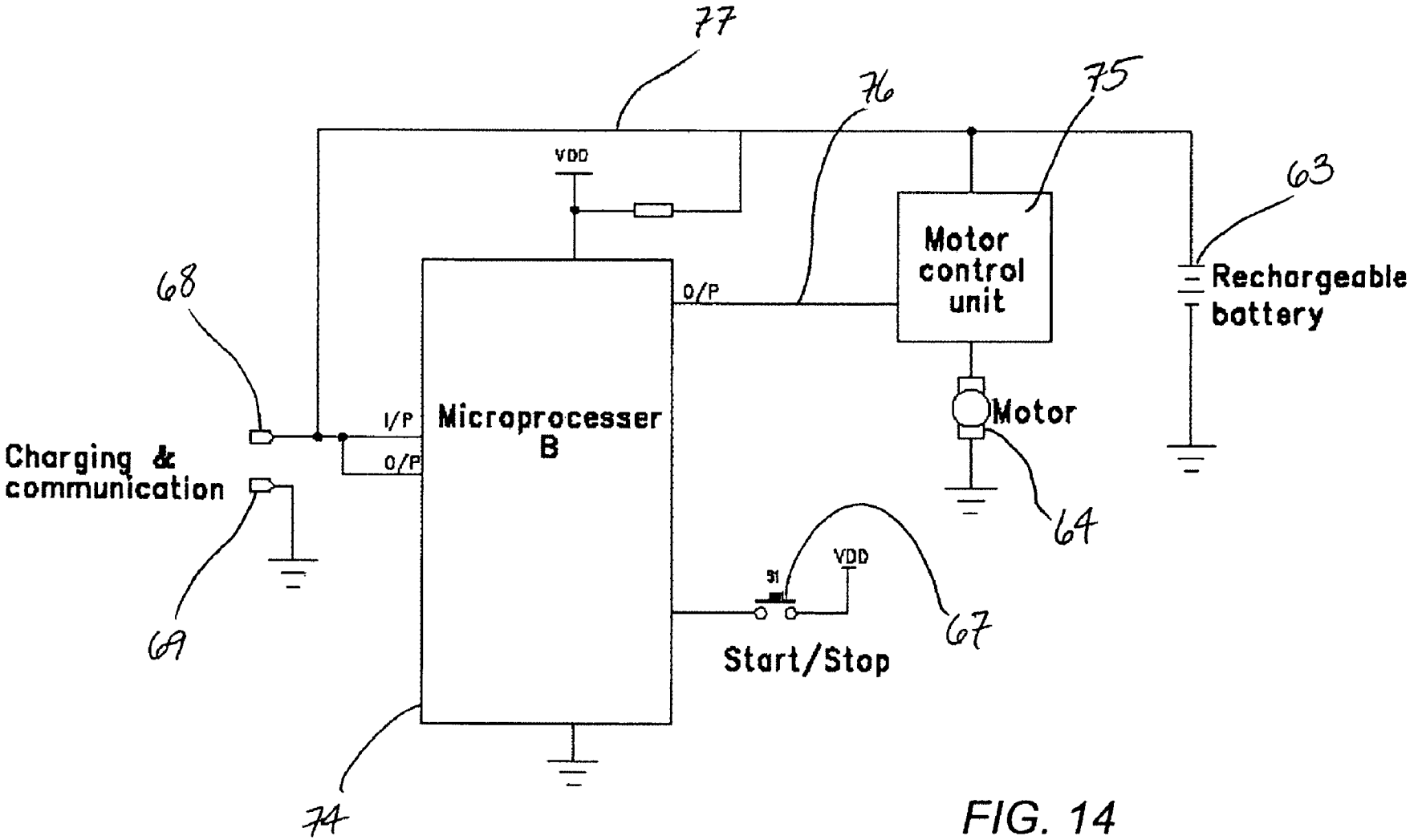
FIG. 14 is a block diagram for the circuit for the plane.
Figure 15:
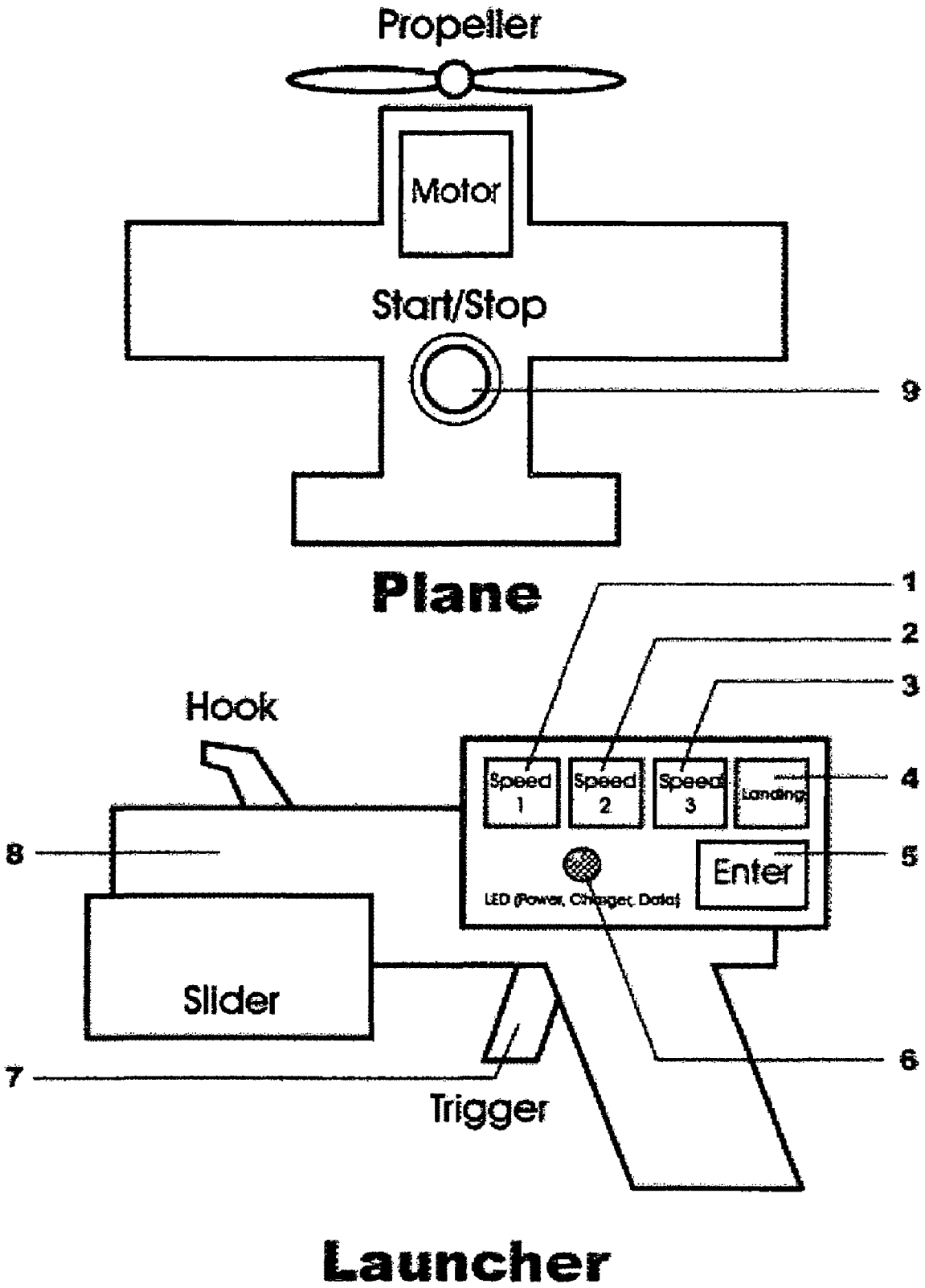
FIG. 15 is a configuration illustrating the concept of the plane associated with the launcher.

The block diagram illustrating the program for the programming device located with the launcher to permit programming is illustrated in FIG. 13. There is a microprocessor 70 which can respond to closing and opening of circuits and switches as effected by the different keys 29, 30, 31, 32 and 33. These keys are those that appear on the keypad 27. As can be seen in FIG. 13, there are keys which represent the fast, medium and slow speeds, the ability to indicate landing, and a key to verify entry of a programmed process.

There is also a speaker 71 associated and operated by the microprocessor 70, and the microprocessor 70 operates the LED driver 72. Further, the microprocessor 70 indicates the detection of the battery and regulates the charging control unit as indicated by block 73. In turn, this regulates the charging and communication through the two wires 37*a* and 39*a*.

Thus, the two wires communicate the charging current from the battery 24 as indicated. These wires also direct programmed data from the programming device 27, which is redistributed to the distributor 36 and in turn returned along wires 37*a* and 39*a*. Thus, there are two wires which do both the charging the communication of the flying object.

On the plane, there is the receiver unit which includes a microprocessor 74 which receives power from the contacts 68 and 69 which have made contact with the contacts 48*a* and 48*b* on top of the launcher. Through this 2-wire contact the microprocessor 74 receives the programmed information from the programmable unit 27 and also ensures that power is directed to the rechargeable battery 63 when the plane is on the launch pad. This power in the rechargeable battery 63 is for operating the motor control unit 75 to operate the motor 64. This motor 64 is connected to operate the propeller 51 and provide motor power. The motor 64 can also operate the rudder and elevators through appropriate connectors.

The start/stop switch 67 is connected to the microprocessor 74 as indicated, and the microprocessor itself is connected through line 76 with the motor control unit and lines 77 are also connected to the motor control unit and the rechargeable battery.

As shown in FIG. 1, the launcher includes a handle pedestal 21 with a launch slider. The trigger 41 is between the forward part of the handle pedestal 21 and the underside of the slide launcher.

The programmable elements permit for different speeds of the plane and landing. An enter button permits for different programs to be communicated to the plane when the plane is located on the launching device.

The plane itself includes the motor 64 for operating the propeller 51. Operation of the propeller 51 at different speeds regulates the speed of the plane, the take-off and landing. The take-off is permitted on release of the hooks 43 when the propeller 51 is rotating to cause a forward propulsion. The plane in turn would land as the propeller 51 slows down. The elevators and rudders are appropriately programmed and regulated to permit landing. The start/stop switch 67 is also on the plane. When the switch 67 is in the start position, communication is possible and the plane can operate. When it is in the stop position, the communication can be cut off and the plane cannot operate.

Figure 16:
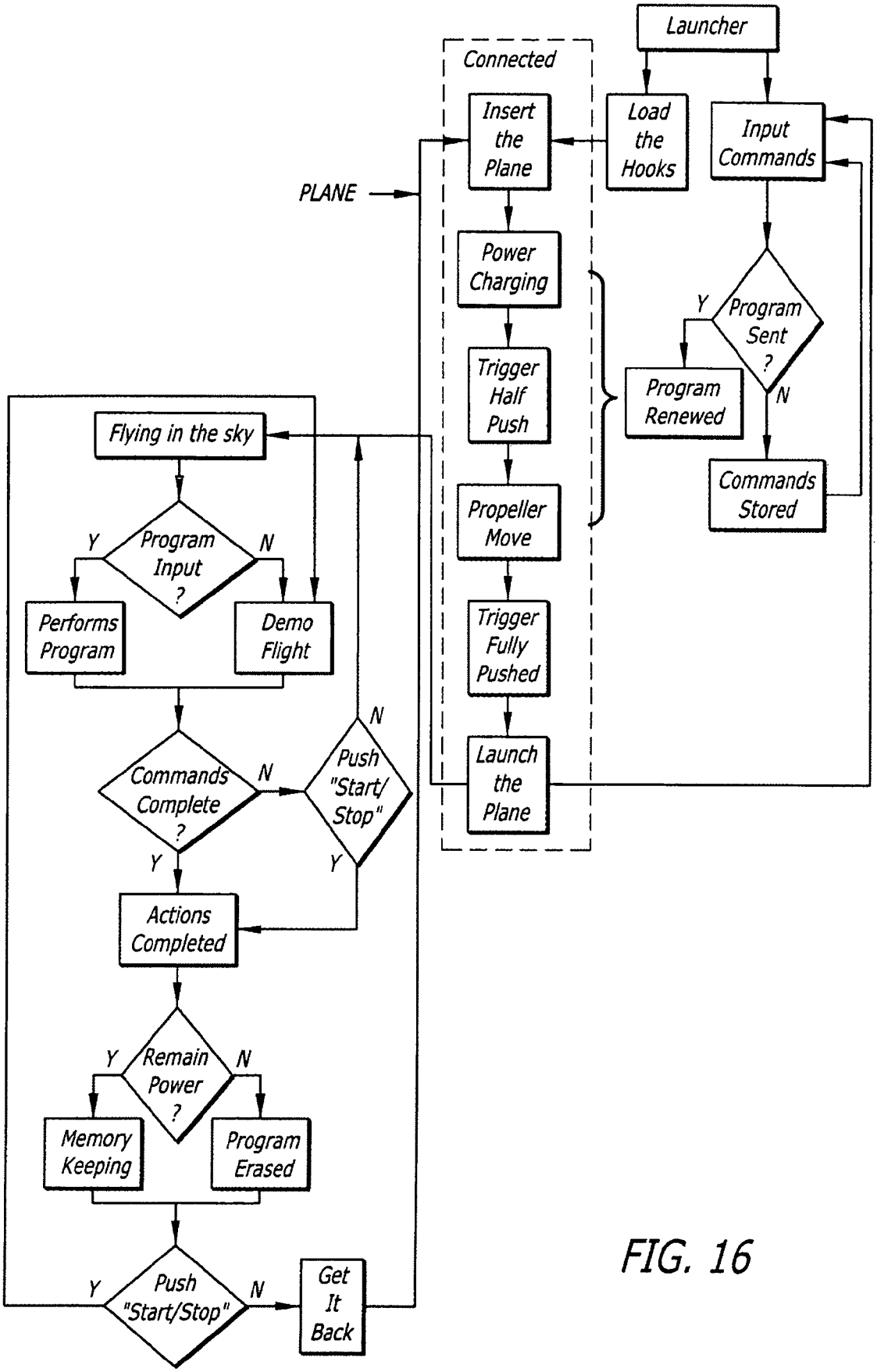
FIG. 16 is the flow diagram associated with the game flow for launching the programmed plane.

As seen in FIG. 16, the operation of the plane as a game or as a toy is illustrated in one format. When the plane and launcher are connected namely when the plane is on the launch pad the first feature is to ensure that the plane is mounted and that the inter-engagement with the hooks 43 is effected. This is achieved by pulling back the slider to restore the power for plane ejection from the slider. The plane is then put onto the slider and power charging is effected.

The first action is that the charger LED 34 goes off after 15 seconds. When the plane is on the slider, different programs can be inputted into the program according to different input commands. The plane receives instructions from the launcher according to those programs. As the different combinations for the program are established, the program can be renewed as indicated. When the program commands are effectively stored this cycles back to the programmer as indicated. When the program has been communicated to the plane, the propeller 51 is started and is kept spinning at an appropriate speed. The trigger 41 is fully pulled back and the plane is launched.

When the plane is launched, the program which has been received by the plane regulates the plane action. As the plane flies in the sky, there can be a performance of the plane according to the preprogrammed instructions in the microprocessor 74 in the plane. In different situations, there can be a demonstration flight where a preprogrammed flight situation is programmed into the plane through a program which can be preset from the programming device 27.

When the plane is programmed to perform a particular flight path or pattern, the action of the motor 64 on the propeller 51, rudder, and elevators causes the plane to operate. The pushing of the start/stop button 67 on the plane can permit the plane to be charged and/or prepare the plane for flight or in operation. It is possible for the program previously in the plane to be erased and a new program inserted as required. After effective programming the plane can be in a state for operation as required.

The system is described with additional details as follows.

Launching Device

Inside the Launcher, there is a microprocessor 70 which includes:

a. RAM to memorize up to 40 programmable steps;

b. a timer for constant time charging of the rechargeable battery pack 63 inside the plane;

c. a sound generator to generate sound effects while pressing any key;

d. keypad interface;

e. Ready-Takeoff function—While half-pressing the trigger 41, the motor 64 runs and the propeller 51 turns in full speed. The advantage is that the plane can get enough upthrust power against gravity during launching.

Slider, hook and trigger are the mechanisms designed to load, hold and eject the plane respectively.

By pressing keys on the keypad 28, users can input some programmable actions such as Fast Speed, Medium Speed, Slow Speed and Landing. After pressing Enter button, all data is transferred from microprocessor 70 on the launcher device 21 to the microprocessor 74 inside plane through the 2-wire metal contact. Another function of this 2-wire metal contact is for charging the rechargeable battery pack inside the plane.

Built-in charger function for refilling the electricity inside the plane.

The LED 34 shows the status of charging and data transfer processing as well.

Plane

Inside the plane, there is the microprocessor 74 which can:

a. retain all programmable steps from the latest data package that were sent from the launcher 21, until the battery is flat;

b. implement the programmable steps by controlling the motor 64, and hence propeller speed and time duration;

c. implement the instant start/stop propeller function by pressing the start/stop switch or key 67;

d. communicate with the microprocessor 70 in the launcher 21 through the 2-wire metal contact. With the battery detector circuitry on the launcher 21, it can detect if the plane is on hook or hooks 43.

By adjusting the rudder manually before launching, the flight direction of the plane can be controlled.

The plane body is made of EPP material for durable and inexpensive purpose.

The following is a further description of the keys and movable parts.

1) Speed 01—slow speed

2) Speed 02—medium speed

3) Speed 03—fast speed

4) Landing—deceleration and then propeller stop

5) Enter—program sends and overwrites the previous version

6) LED light is on when battery is being charged light is off when charging has finished or the plane does not connect light blinks when data is being transmitted 7) Trigger when pushed half-way, propeller is activated for flying when pushed all the way, the plane is released 8) Launcher stores power for launching the plane key panel for inputting commands 9) Start/Stop button program is stopped if button is pushed during flight programming when program is stopped, it recycles to a demo flight if the button has been pushed propeller will stop again if the button pushed once again Operation of the Device The operation of the programmable plane could be divided into following steps:

1) Load the Hooks

Pull back hooks to "Lock" position.

2) Insert the Plane

The plane is mounted with the hooks, to ensure the plane is in contract with the charger port. When the LED lights are on, the charging procedure starts. The LED light operates for approximately 80 seconds until the unit has been completely charged.

3) Input Commands

The commands to create a flight pattern are keyed in, and the commands are stored. There is a maximum memory of up to 40 steps. To save the commands into the plane, push "Enter" button.

4) Activate Propeller Movement

Pulling the trigger half-way causes the propeller to spin at a constant speed, at which point the plane is ready for launch.

5) Launch the Plane:

Pulling the trigger all the way effects release of the plane, propelling the plane into the air.

6) Actions While Plane is Mid-Flight:

The plane follows the commands programmed into the microprocessor of the plane to perform the programmed actions.

7) Retrieve the Plane:

The plane is stopped when the plane has completed all commands, or becomes trapped, or runs out of power. The plane is retrieved for the next flight.

8) Instant Start/Stop:

The start/stop button 67 at the bottom of the plane allows the player to enable or disable the action of the propeller 51 at any time, when even the plane is performing actions. Pushing the button once stops the spinning propeller, and pushing the button once more starts the propeller spinning again.

General Features of the Device

The device can store up to 40 commands.

The memory in the plane retained by stored power inside the plane.

Pulling the trigger half way causes the propeller to spin at the first level of speed. Pulling the trigger completely causes the holder to release the plane and the received program in the plane begins execution.

The plane takes actions following the stored commands in the receiver microprocessor 74.

The commands cannot be completed if there is a power outage during the middle of the process of execution.

While the device, apparatus and method has been described in terms of what is presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures.

In some cases, instead of batteries 24 in the base, the launcher may be connected to an electric power source. In other cases, instead of a plane which flies, there be other vehicles which can be launched by the launch pad. For instance, there may be a ski boat or other vehicle such as a stunt car. In some cases, a different number of commands, more or less than 40, can be stored in the microprocessor, if the microprocessor permits more storage. Less than 40 commands is possible by entering less commands. A preprogrammed demonstration program can be used as well as other preprogrammed programs if preferred.

The present invention is not limited to the embodiments described above, but includes any and all embodiments of the following claims.

The invention claimed is:

1. A programmable flying toy system comprising:

a flyable toy object including a body, an element with the body to permit flight, and a rotating element located on the front of the flyable toy object to permit propulsion of the object, wherein the sole propulsion element on the flyable toy object is the rotating element;

a handheld launch device for receiving the flyable toy object prior to flight, wherein the launch device is not for remotely controlling the flyable toy object during flight;

a spring-loaded release to launch the flyable toy object from the launch device and to take flight, the spring-loaded release having a spring for propelling the flyable toy object from the launch device;

the flyable toy object further including a motor for operating at least one element of the flyable toy object, and a receiver for interacting with the motor according to a flight pattern transmitted to the receiver;

the launch device including a programming device, the programming device having an input device and a programmable microprocessor, the input device for inputting at least one command to the programmable microprocessor, and a communication circuit for transmitting a flight pattern from the programmable microprocessor to the receiver of the flyable toy object only prior to flight; and the launch device further including a trigger, wherein half-pressing the trigger activates the rotating element and fully pressing the same trigger facilitates the spring-loaded release in launching the flyable toy object from the launch device.

2. The flying toy system as claimed in claim 1, wherein the motor in the flyable toy object controls at least one of a rudder, propeller, or elevator associated with the flyable toy object.

3. The flying toy system as claimed in claim 1, wherein the programmable microprocessor stores one or more inputted commands together as a flight pattern, prior to transmission of the flight pattern represented by the stored commands to the receiver of the flyable toy object.

4. The flying toy system as claimed in claim 3, wherein the programmable microprocessor further controls at least one of a speaker, battery detector, charging control unit, or LED driver.

5. The flying system toy as claimed in claim 1, wherein the input device is a keypad, voice command, joystick, light, or infrared input.

6. The flying toy system as claimed in claim 1, wherein the programming device communicates with the receiver of the flyable toy object by a hard-wire connection to the receiver of the flyable toy object when the flyable toy object is located on the launch device.

7. The flying toy system as claimed in claim 1, further including at least one rechargeable battery inside the flyable toy object and wherein the launch device includes a compartment for receiving a battery, the battery in the launch device being for permitting charging to disseminate from the launching device to the at least one rechargeable battery in the flyable toy object.

8. The flying toy system as claimed in claim 7, wherein a hard wire connection between the flyable toy object and the launch device transmits both data communication between the programming device of the launch device and power to the at least one rechargeable battery of the flyable toy object.

9. The flying toy system as claimed in claim 1, wherein the launching device is a unit with a base permitting standing on a foundation and being balanced to prevent tipping when the flyable toy object is located on the launching object and to prevent tipping when the flying toy object is removed from the launching device.

10. The flying toy system as claimed in claim 1, wherein the launching device includes a base, an upstanding pedestal and a launch ramp, the launch ramp being directed substantially in line and forwardly in the same direction as the base.

11. A programmable flying toy system comprising:

a flyable toy object including a body, an element with the body to permit flight, and a rotating element located on the front of the flyable toy object to permit propulsion of the object, wherein the sole propulsion element on the flyable toy object is the rotating element;

a launch device for receiving the flyable toy object prior to flight;

a spring-loaded release to launch the flyable toy object from the launch device and to take flight, the spring-loaded release having a spring for propelling the flyable toy object from the launch device;

the flyable toy object further including a motor for operating at least one element of the flyable object, and a receiver for interacting with the motor according to a flight pattern transmitted to the receiver; and the launch device including a programming device, the programming device having an input device and a programmable microprocessor, the input device for inputting at least one command to the programmable microprocessor, and a communication circuit for transmitting a flight pattern from the programmable microprocessor to the receiver of the flyable toy object only prior to flight, wherein the programming device communicates with the receiver of the flyable toy object by a hard-wire connection to the receiver of the flyable toy object only when the flyable toy object is located on the launch device; and the launch device further including a trigger, wherein half-pressing the trigger activates the rotating element and fully Dressing the same trigger facilitates the spring-loaded release in launching the flyable toy object from the launch device.

12. The flying toy system as claimed in claim 11, wherein the programmable microprocessor stores one or more inputted commands together as a flight pattern, prior to transmission of the flight pattern represented by the stored commands to the receiver of the flyable toy object.

* * * * *